US008887419B2

(12) United States Patent
Flesher et al.

(10) Patent No.: US 8,887,419 B2
(45) Date of Patent: Nov. 18, 2014

(54) THREE DIMENSIONAL FOAM GREETING CARDS

(71) Applicant: American Greetings Corporation, Cleveland, OH (US)

(72) Inventors: Melissa Flesher, Avon, OH (US); Erin Dennis, Lakewood, OH (US); Seth Larson, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 13/745,157

(22) Filed: Jan. 18, 2013

(65) Prior Publication Data

US 2013/0125429 A1 May 23, 2013

Related U.S. Application Data

(60) Continuation-in-part of application No. 13/459,553, filed on Apr. 30, 2012, now abandoned, and a (Continued)

(51) Int. Cl.

| | |
|---|---|
| ***G09F 1/00*** | (2006.01) |
| ***B42D 15/02*** | (2006.01) |
| ***B42D 15/00*** | (2006.01) |
| ***B42D 15/04*** | (2006.01) |
| ***G09F 1/08*** | (2006.01) |

(52) U.S. Cl.

CPC ..... *B42D 15/022* (2013.01); *B42D 15/0093* (2013.01); *B42D 15/045* (2013.01); *G09F 1/08* (2013.01); *B42D 15/042* (2013.01)

USPC ..... 40/124.03; D19/1

(58) Field of Classification Search

CPC ..... B42D 15/02; G09F 1/00; G09F 1/08

USPC ..... 359/439; 40/599, 638, 594, 595

See application file for complete search history.

(56) References Cited

U.S. PATENT DOCUMENTS 1,853,622 A * 4/1932 Kennedy ..... 281/29
2,927,400 A 3/1960 Bailey (Continued)

FOREIGN PATENT DOCUMENTS

NL 1033961 12/2007

OTHER PUBLICATIONS

"Motor/Sound Module for Greeting Card", retrieved on Oct. 17, 2001 from http://www.alibaba.com/product-gs/358784246/Motor_Sound_Module_for_Greeting_Card.html.

*Primary Examiner* — Charles A Fox
*Assistant Examiner* — Shin Kim
(74) *Attorney, Agent, or Firm* — Christine Flanagan

(57) ABSTRACT

Three-dimensional lightweight foam greeting cards are described herein having a foam body with a perimeter wall that extends between two spaced apart parallel pieces of planar sheet material such as heavy gauge paper, cardboard, or other such material. The greeting cards have a partially hollowed foam body or one or more cavities in the foam body concealed in the front and back by the planar sheet material which may be pre-cut in the shape of the foam body are decorated consistent with the design of the foam body. The cavities in the foam body may contain various electronic components that enable the greeting card to produce sound, record and playback a personalized message, trigger light activation, trigger the movement of moveable parts, display digital video, photographs or slideshows, or a combination thereof.

3 Claims, 12 Drawing Sheets

Related U.S. Application Data continuation of application No. 13/004,544, filed on Jan. 11, 2011, now Pat. No. 8,205,365, and a continuation-in-part of application No. 13/270,611, filed on Oct. 11, 2011, now Pat. No. 8,448,361, and a division of application No. 12/940,145, filed on Nov. 5, 2010, now Pat. No. 8,230,624, and a continuation-in-part of application No. 13/657,199, filed on Dec. 6, 2012, now Pat. No. 8,763,286, and a continuation-in-part of application No. 13/176,103, filed on Jul. 5, 2011, now Pat. No. 8,316,565.

(56) References Cited

U.S. PATENT DOCUMENTS

| | | | | |
|---|---|---|---|---|
| 5,025,580 | A | 6/1991 | Asai | |
| 5,063,698 | A | 11/1991 | Johnson et al. | |
| 5,464,681 | A * | 11/1995 | Luce | 428/195.1 |
| 5,549,940 | A * | 8/1996 | Noone | 428/31 |
| 5,743,035 | A | 4/1998 | Bradley et al. | |
| 6,219,949 | B1 * | 4/2001 | Pang | 40/599 |
| 6,282,819 | B1 * | 9/2001 | Gu | 40/124.03 |
| 6,357,152 | B1 | 3/2002 | Brooks et al. | |
| 6,460,277 | B1 | 10/2002 | Tower | |
| 6,461,705 | B2 * | 10/2002 | Eichhorn | 428/38 |
| 6,524,674 | B1 * | 2/2003 | Eichhorn | 428/38 |
| 6,643,964 | B1 * | 11/2003 | Stern | 40/599 |
| 6,752,891 | B2 * | 6/2004 | Eichhorn | 156/233 |
| 6,827,812 | B2 * | 12/2004 | Woods | 156/291 |
| 6,848,965 | B2 | 2/2005 | Wong | |
| 7,201,402 | B2 | 4/2007 | Duprey | |
| 7,356,154 | B1 * | 4/2008 | Kotzin | 381/334 |
| 7,634,864 | B2 | 12/2009 | Segan | |
| 7,856,744 | B2 * | 12/2010 | Crow et al. | 40/310 |
| 8,052,534 | B2 * | 11/2011 | Crouch et al. | 463/47 |
| 8,230,624 | B2 | 7/2012 | Sapp et al. | |
| 8,256,150 | B2 | 9/2012 | Qiao et al. | |
| 8,595,961 | B2 * | 12/2013 | Mayer et al. | 40/124.03 |
| 8,601,726 | B2 * | 12/2013 | Mayer et al. | 40/124.01 |
| 2004/0000080 | A1 * | 1/2004 | Massey | 40/599 |
| 2004/0237359 | A1 | 12/2004 | Lee | |
| 2007/0068052 | A1 * | 3/2007 | Oliviero et al. | 40/124.08 |
| 2008/0032587 | A1 | 2/2008 | Krivanek et al. | |
| 2008/0289230 | A1 * | 11/2008 | Mandelbaum et al. | 40/124.01 |
| 2009/0050505 | A1 * | 2/2009 | Rubin | 206/459.5 |
| 2009/0126239 | A1 | 5/2009 | Clegg | |
| 2009/0241387 | A1 | 10/2009 | Wong | |
| 2010/0032936 | A1 * | 2/2010 | Anderson et al. | 283/100 |
| 2012/0266503 | A1 | 10/2012 | Sapp et al. | |
| 2012/0304510 | A1 | 12/2012 | Qiao et al. | |

* cited by examiner

THREE DIMENSIONAL FOAM GREETING CARDS

RELATED APPLICATIONS

This application is a continuation-in-part of U.S. patent application Ser. No. 13/459,553, filed on Apr. 30, 2012, which is a continuation of and claims priority to U.S. patent application Ser. No. 13/004,544, filed on Jan. 11, 2011 (now U.S. Pat. No. 8,205,365). This application is also a continuation-in-part of and claims priority to U.S. patent application Ser. No. 13/270,611, filed on Oct. 11, 2011, which is a divisional of U.S. patent application Ser. No. 12/940,145, filed on Nov. 5, 2010 (now U.S. Pat. No. 8,230,624). This application is also a continuation-in-part of and claims priority to U.S. patent application Ser. No. 13/657,199, filed on Dec. 6, 2012, which claims priority to U.S. patent application Ser. No. 13/176,103, filed on Jul. 5, 2011 (now U.S. Pat. No. 8,316,565). Each of the above-referenced patent applications are incorporated herein by reference in their entirety.

FIELD OF THE INVENTION

The present invention relates to greeting cards, and more specifically to three-dimensional foam greeting cards and decorative greeting card accessories.

BACKGROUND OF THE INVENTION

For many years paper greeting cards have been widely used for celebratory occasions such as birthdays, graduations, weddings and other commercial purposes. Traditional text information is generally found on paper greeting cards. More recently, sound has been added to traditional paper greeting cards to increase the personalization of the cards by delivering an audio message that is electronically embodied in circuitry that is carried within the greeting card. The ability to use sound in combination with printed matter such as with conventional printed greeting cards significantly enhances the communicative value of social and relational greetings. The availability of small voice recording sound modules has made sound-generating greeting cards increasingly popular. Small lighting systems have also been incorporated into social greeting products and novelties, and combined in circuits with sound and other features.

SUMMARY OF THE INVENTION

A three-dimensional foam greeting card is described herein, in one embodiment, having a three-dimensional foam body, a first planar surface material attached to a front surface of the three-dimensional foam body, a second planar surface material attached to a back surface of the three-dimensional foam body and a sound module located in a recess in the three-dimensional foam body and concealed by the first and second planar surface material. The sound module may include a speaker, circuit board, integrated circuit, microprocessor, memory device, power source, at least one switch mechanism and at least one pre-loaded digital audio file. The at least one switch mechanism controls playback of the at least one pre-loaded digital audio file.

In another embodiment, the three-dimensional foam greeting card of the present invention contains a three-dimensional foam body having at least one hollowed out portion creating a cavity therein, a first planar surface attached to a front surface of the three-dimensional foam body, a second planar surface attached to a back surface of the three-dimensional foam body, a sound module comprising a speaker, circuit board, integrated circuit, microprocessor, power source, memory device and at least one pre-loaded audio file, a recording device, a first switch to initiate a user recording session, and a second switch to initiate playback of the at least one pre-loaded audio file or a user recorded message.

In still another embodiment, the foam greeting card contains a three-dimensional foam body with a perimeter wall which extends between two spaced apart parallel pieces of heavy gauge planar sheet material, and a multimedia player device located and concealed within the three-dimensional foam body. The multimedia player device may include a circuit board, integrated circuit, microprocessor, speaker, power source, memory device, an electronic display screen operative to display digitally generated images, a data storage device, at least one switch mechanism, and at least one pre-loaded digital audio or video file. The electronic display screen is visible through an opening in the three-dimensional foam body and one of the pieces of heavy gauge planar sheet material.

DETAILED DESCRIPTION OF PREFERRED AND ALTERNATE EMBODIMENTS

The present disclosure and related inventions provide foam constructs in the form of greeting devices, greeting cards, novelties, gifts and foam constructs with functional features, and which can be used in connection with other devices such as retail displays.

Figure 3:
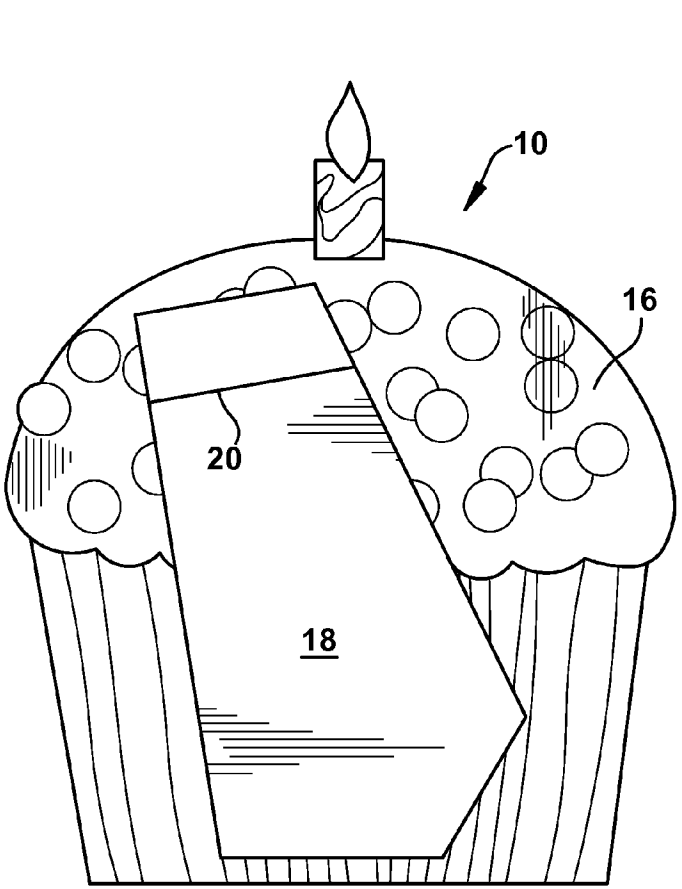
FIG. 3 is a rear view of the three-dimensional foam greeting card of FIG. 1.
Figure 2:
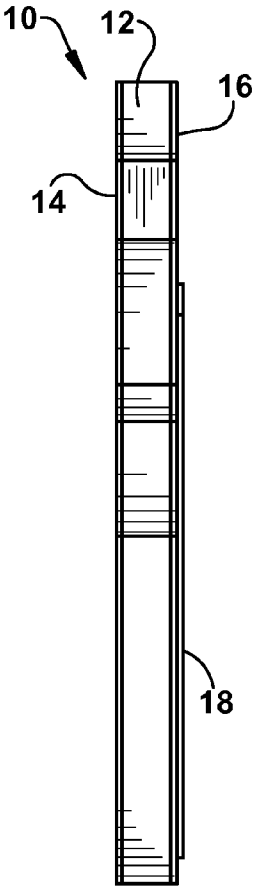
FIG. 2 is a side view of the three-dimensional foam greeting card of FIG. 1.
Figure 9:
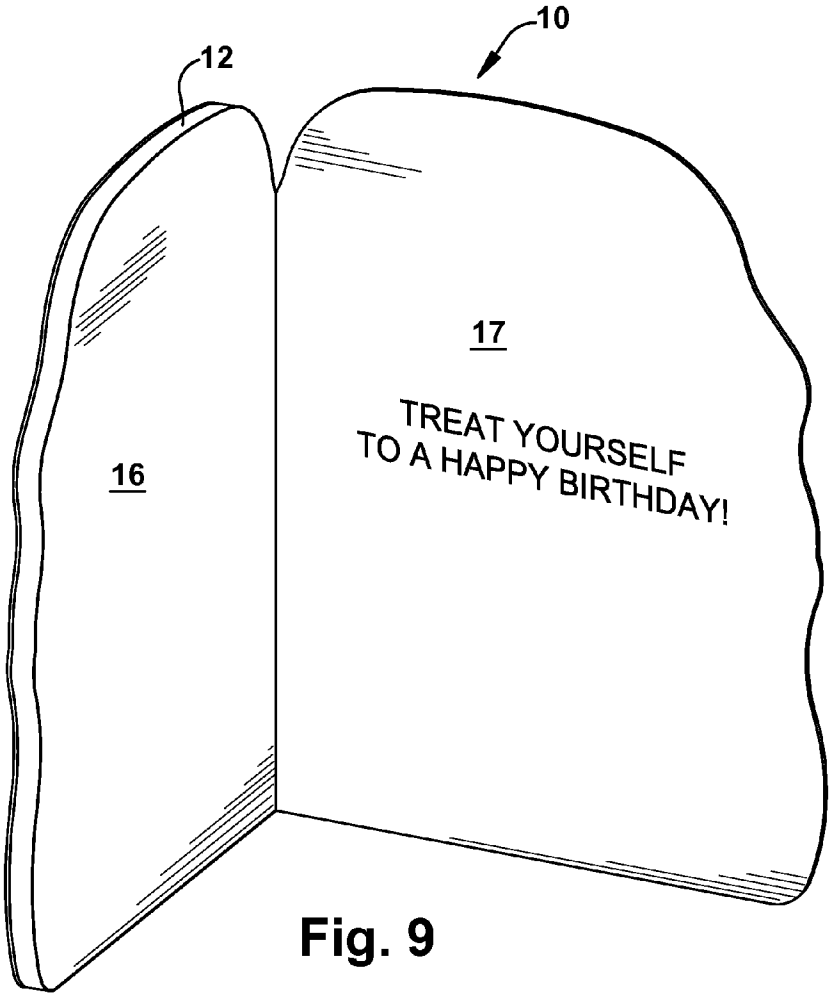
FIG. 9 is a perspective view of the three-dimensional foam greeting card of FIG. 8 in an open position.
Figure 8:
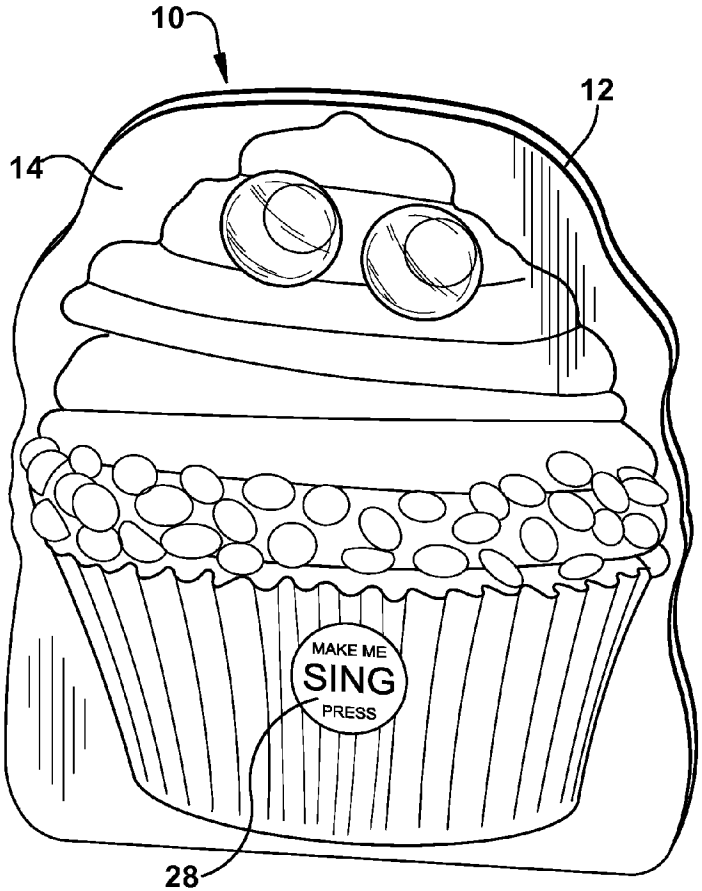
FIG. 8 is a front view of an alternate embodiment of the three-dimensional foam greeting card of the present invention in a closed position.

In one form, a three-dimensional foam greeting card according to the present invention contains a foam body made of a hardened foam or foam-like material which makes the greeting card very lightweight. A representative example is shown in FIGS. 1-4. The foam body 12 of the greeting card 10 can be formed into any shape or profile, examples of which include, but are not limited to: a circle, a cupcake, a candle, an animal, a person, a baby carriage, a Christmas tree, a pumpkin, or any other conceivable shape. Or the greeting card 10 may take on a square or rectangular shape of a traditional greeting card. A portion of the foam body 12 is hollowed out to accommodate a device, examples of which include, but are not limited to: a sound module (shown in FIG. 4), a light module, a motor module, a multimedia player device or any combination thereof. There may be multiple cavities formed in the foam body 12 to receive multiple devices or device components such as batteries, switches, circuit boards, speakers, motors, recording devices, etc. The front and back surfaces of the foam body 12 are generally planar and can be covered with a heavy gauge paper-like material such as paper, cardboard, cardstock, or any other sheet or planar material. The outer paper-like surface 14, 16 can be cut in the shape of the foam body 12 and pre-printed with a design consistent with the shape of the foam body 12. The front surface 14 may bear decoration consistent with a front view of the item and the back surface 16 may contain decoration consistent with the back view of the item. For example, if the foam body and outer cover contain the shape and decoration of a dog, the front cover of the foam greeting card may contain the right side profile of the dog and the back cover may contain the left side profile of the dog. The outer surfaces 14, 16 are adhesively or otherwise attached to the foam body 12. The greeting card 10 may contain, in addition to the three-dimensional foam body 12 with planar front 14 and back 16 surfaces, a sentiment panel 17, which may be connected to the planar sheet material located on either the front 14 or back 16 surface of the foam body 12. This configuration is shown in FIGS. 8 and 9. The sentiment panel 17 may be, as shown, shaped in the same way as the foam body 12 and corresponding front 14 and back 16 sheet materials. If the sentiment panel 17 is connected along a fold line to the planar sheet material located on the front surface 14 of the foam body 12, it would serve as an outside front cover and an inside left panel of the greeting card 10. In a closed position, the sentiment panel 17 would be folded over the front surface 14 of the foam body 12 revealing only the outer surface of the sentiment panel 17. In an open position, it would be folded away from and revealing the front surface 14 of the greeting card 10 and the inner surface of the sentiment panel 17. Text sentiment and/or printed photographs or graphics may be contained on both the inside and outside surface of the sentiment panel. If the sentiment panel is connected along a fold line to the planar sheet material located on the back surface 16 of the foam body 12, as is shown in FIG. 9, it would serve as an outside back cover of the greeting card 10 and an inside right panel of the greeting card 10. In a closed position, the sentiment panel 17 would be folded over the back surface 16 of the greeting card 10. In an open position, it would be folded away from the back surface 16 of the greeting card 10 revealing the back surface 16 of the greeting card 10 and the inner surface of the sentiment panel 17. The three-dimensional greeting card 10 may additionally contain a display arm 18 attached to the back surface 16 of the greeting card 10, as shown in FIG. 3. The display arm 18 may be made out of cardboard or other rigid material. The upper portion of the display arm 18 is creased along a fold line 20 so that the display arm 18 may bend outward to function as a support for the greeting card 10, allowing the greeting card 10 to be displayed in a standing position.

Figure 4:
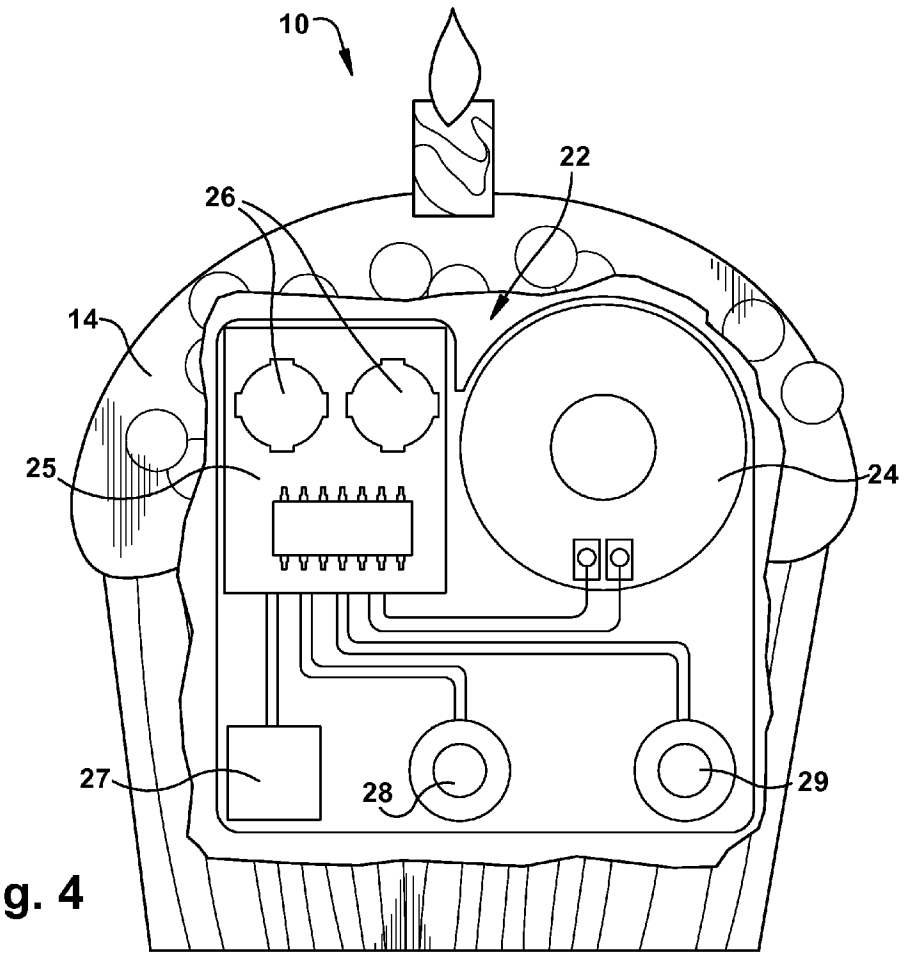
FIG. 4 is a front internal view of the three-dimensional foam greeting card of FIG. 1.

In another embodiment, the foam greeting card, as described above, may contain a sound module 22, as shown in FIG. 4. Components of the sound module may include a circuit board 25, an integrated circuit, a microprocessor, a speaker 24, a memory module, a power source 26, a switch 28, and any other components necessary to trigger and playback a pre-recorded digital audio file. The digital audio file may contain music, singing, a voice message, or any other recordable sound. Components of the sound module 22 may be contained and concealed within a hollowed out portion of the foam body 12. The switch 28 which triggers playback of the audio file may be an electro-mechanical push-button switch 28. This type of switch may be implemented as a press-button 28, wherein each time a user presses the button, playback of the audio file is initiated. A sticker or printed label may be placed above the press-button switch on the outer surface 14 of the greeting card 10 to indicate that this is the area the user must press to playback the audio file. The sticker or printed label may simply say "play" or "press here". Alternatively the surface of the greeting card 10 above the press-button may be printed with words and/or indicators to designate the location of the push-button 28. The switch may alternatively be a mechanical on/off switch which may be located on the front or back surface of the foam greeting card or it may also be located along the perimeter of the foam body 12. A slide trigger switch may also be used to initiate playback of the pre-recorded digital audio file. This type of switch may be particularly used with a foam greeting card having a sentiment panel, as described above, attached to the front or back surface of the greeting card. A slide switch mechanism may be placed over a fold line between the sentiment panel and the foam body such that when the greeting card is opened by moving the sentiment panel away from the foam body, the slide trigger activates the pre-recorded audio. Other switch mechanisms may be used such as light sensitive switches, motion sensitive switches, touch sensitive switches, pressure sensitive switches, thermal switches, moisture or capacitive switches or any other switch which would be known to one skilled in the art.

Figure 1:
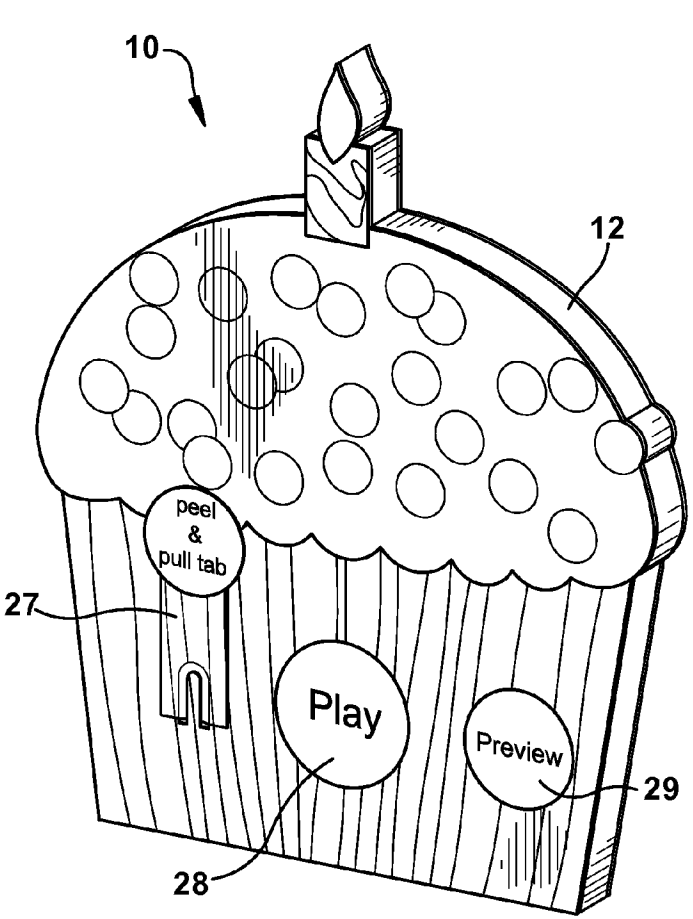
FIG. 1 is a perspective view of a first embodiment of the three-dimensional foam greeting card of the present invention.

In another embodiment, the three-dimensional foam greeting card, as described above, contains both a sound and recording module that provide the user with the ability to record a personalized message to the card recipient. As shown in FIGS. 1 and 4, this embodiment may include at least two electro-mechanical switches 28, 29 to initiate a recording session and a playback session and a microphone. A first switch 28 or "play" button, which may be implemented as a push-button switch as described above, may in a first mode initiate playback of a pre-recorded message instructing the user how to record a personal message and in a second mode initiate playback of the user's personal message. A second switch 29, or "preview" button, which may also be implemented as a push-button, may initiate a recording session wherein the user may record a personal message to the greeting card recipient. A third switch 27 or pull tab is located on the outer surface of the greeting card. This third switch 27 controls whether the greeting card 10 is in a first mode, wherein a user can test the card functionality by recording and previewing the recorded message without the ability to play the message a second time or to hear the message upon pressing the "play" button, or a second mode, wherein the user has purchased the greeting card, and removed the pull tab 27 thereby permitting the user to record a message which is then saved within the sound module and is thereby available for playback upon pressing the "play" button 28. The third switch or pull tab 27 may be located on the outer surface of the greeting card 10 so that is visible to the purchaser. While the pull tab 27 is still intact, pressing the "play" button will initiate playback of a pre-recorded voice message instructing the user how to record a personal message. Once the pull tab 27 has been removed, pressing the "play" button 28 will initiate playback of the user-recorded message. Pressing the "preview" button 29 initiates a recording session, regardless of whether the pull tab 27 has been removed or not. The recording session will continue as long as the user continues pressing or holding down the "preview" button 29 or until the amount of storage allotted for the user-recorded message has been exhausted. Once the user has finished recording the personal message, the personal message will automatically be played back. In the first mode, when the pull tab 27 is still intact, the user-recorded message is played back once and discarded, disabling further playback of the user-recorded message. In the second mode, once the pull tab 27 has been removed, the user-recorded message is immediately played back and saved so that it can be re-played by pressing the "play" button 28. The user may record over a previous message simply by pressing the "preview" button 29 and recording a new message which will overwrite the previously saved user-recorded message. The "preview" button 29 may be indicated on the outer surface of the greeting card by a removable sticker or label. Once the user purchases the greeting card and has recorded a satisfactory message, he/she can remove the "preview" sticker or label before sending the greeting card to the recipient.

Figure 6:
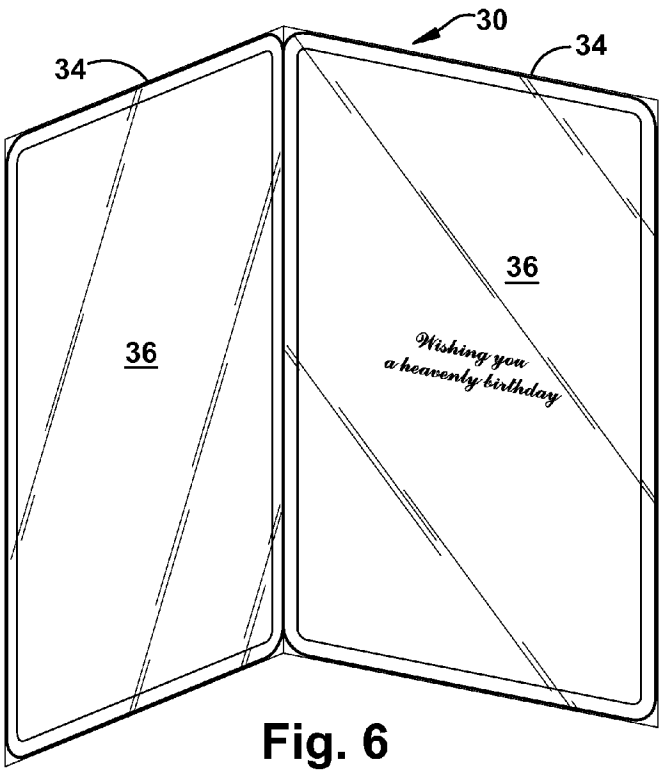
FIG. 6 is a perspective view of the three-dimensional foam greeting card of FIG. 5 in an open position.
Figure 7:
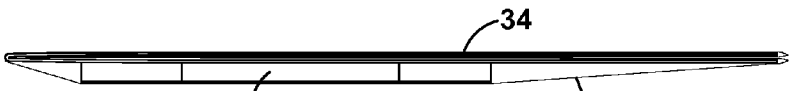
FIG. 7 is a top view of the three-dimensional foam greeting card of FIG. 5 in the direction of arrows 7-7.
Figure 5:
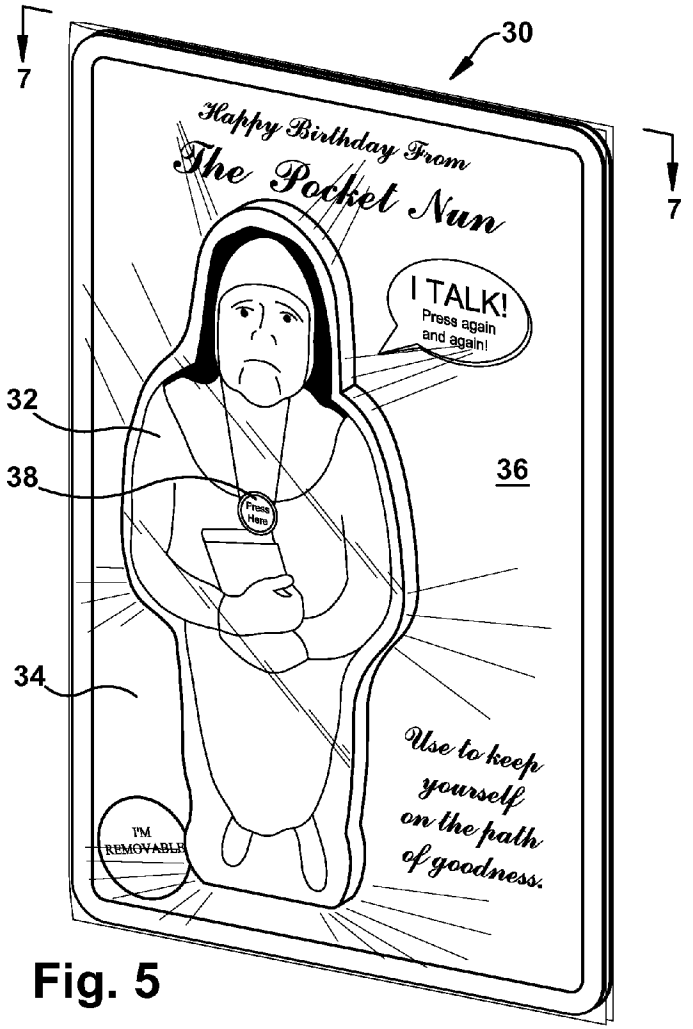
FIG. 5 is a perspective view of an alternate embodiment of the three-dimensional foam greeting card of the present invention in a closed position.
Figure 21:
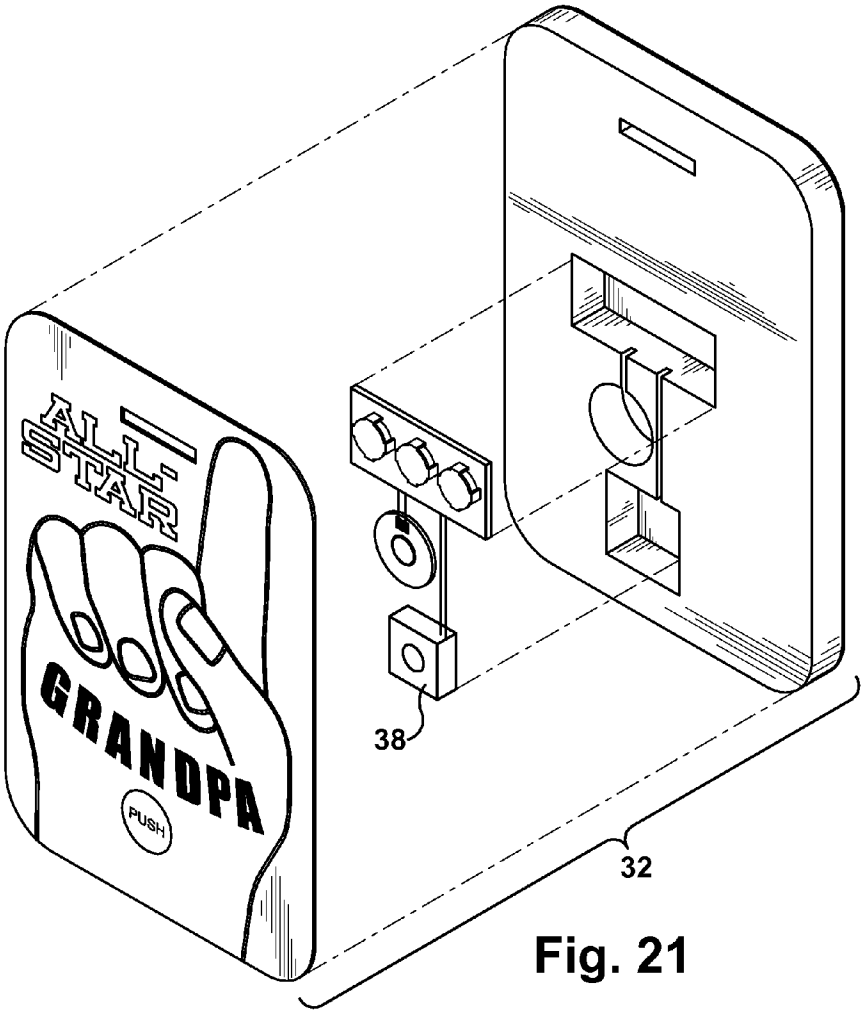
FIG. 21 is an exploded view of the three-dimensional foam greeting card of the FIG. 20.
Figure 20:
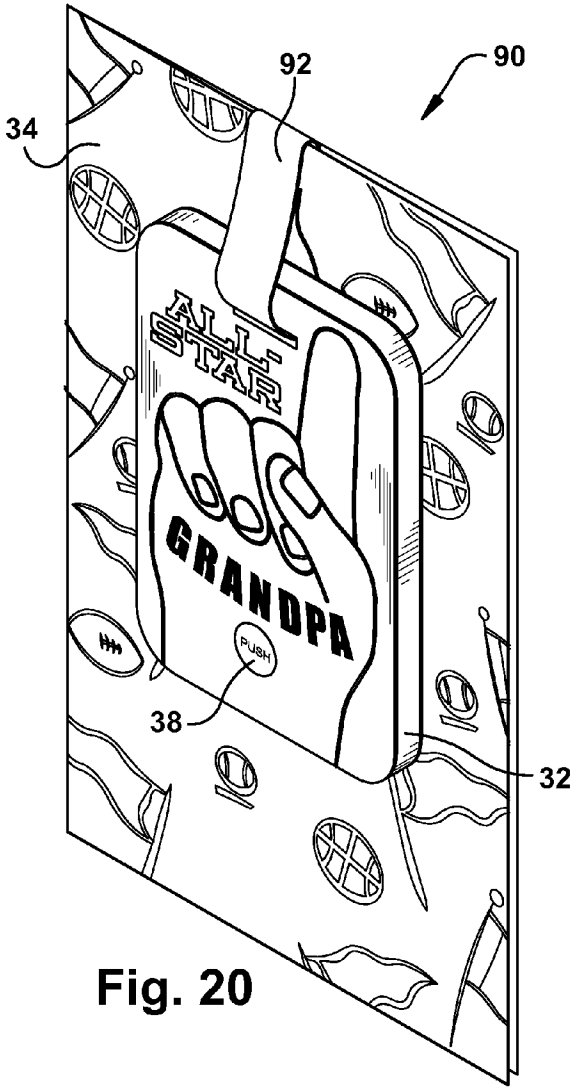
FIG. 20 is a perspective view of an alternate embodiment of the three-dimensional foam greeting card of the present invention.

In another form, the three-dimensional foam greeting card of the present invention may be paired with a traditional paper greeting card, such as is shown in FIGS. 5-7. In this embodiment, the removable foam greeting card 32 may serve as a keepsake or token once the paper greeting 34 has been discarded. As shown in FIGS. 5-7, a sealed clear or transparent sleeve 36 made of plastic or other such material is used to pair the separate foam structure 32 and paper greeting card 34 in the same package. The foam structure 32 may be inserted into the sleeve 36 in front of the paper greeting card 34 so it is visible when looking at the greeting card 30 on a greeting card display. Alternatively, the foam structure 32 may be placed on the inside of the paper greeting card 34 to be discovered by the card recipient upon opening the greeting card 30. The foam structure 32 may contain sound, recording, light, motor, multimedia module, or combinations thereof as described in further detail below. As shown in the representative embodiment, the removable foam structure 32 contains a press button 38 which controls activation of an internal sound module, similar to the sound module shown in FIG. 4. Depression of the press button 38 may initiate playback of a pre-loaded audio file containing a voice message, music, sound, or any other digital recording. Also, as shown in FIGS. 20 and 21, an alternate embodiment of the paper greeting card 34 with removable three-dimensional foam keepsake 32 may have an attached lanyard or other rope, string, ribbon or fabric 92 which would allow the greeting card recipient to remove the keepsake foam piece 32 and wear it around his/her neck. Other types of attachments, such as elastic bands, key chains, pins (for attaching to a shirt lapel or jacket), magnets (for attaching to a refrigerator or other metal object) or any other mechanism that would allow the greeting card recipient to wear or otherwise display the foam portion of the greeting card may be included.

Figure 18:
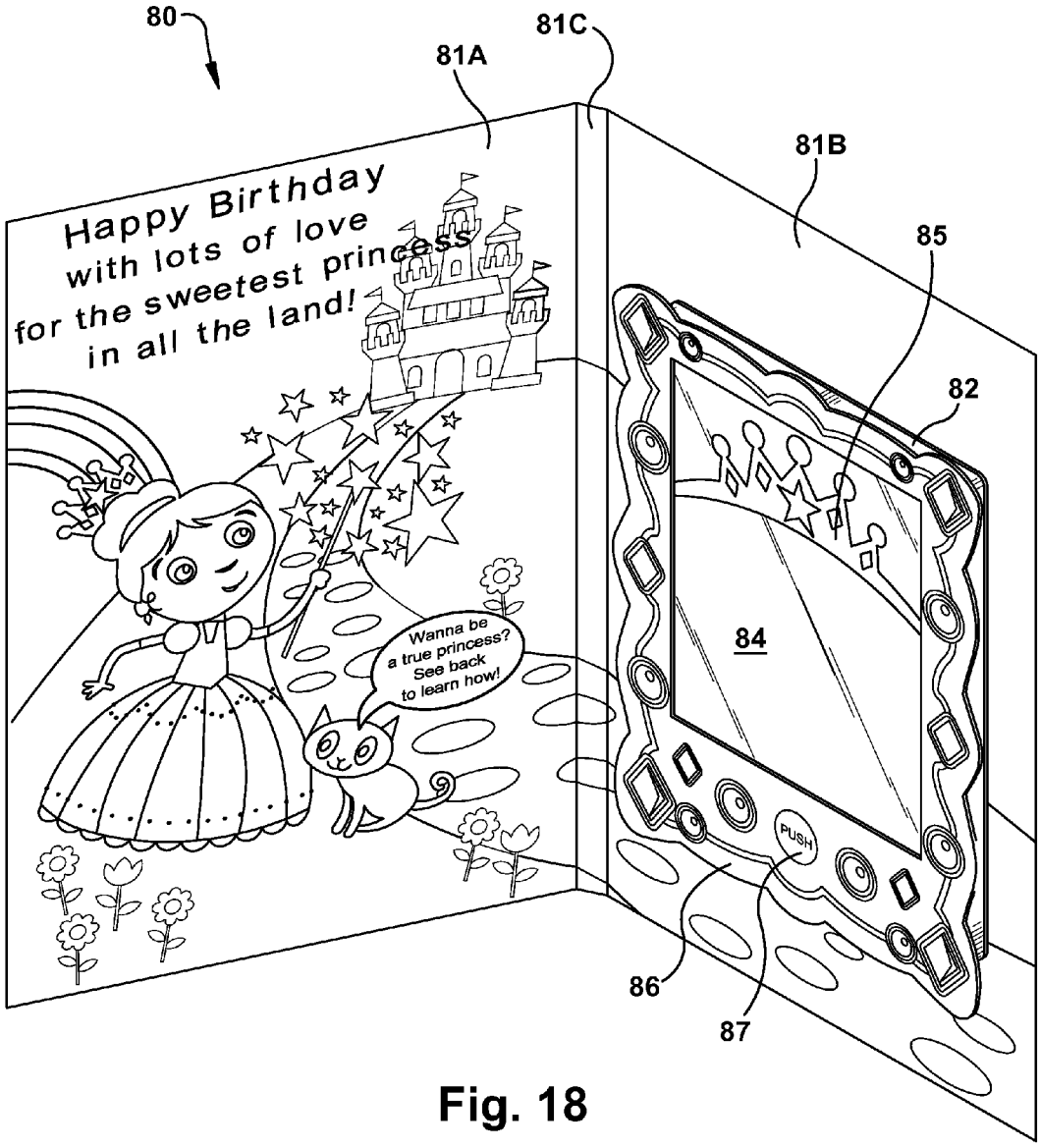
FIG. 18 is a perspective view of an alternate embodiment of the three-dimensional foam greeting card of the present invention.
Figure 19:
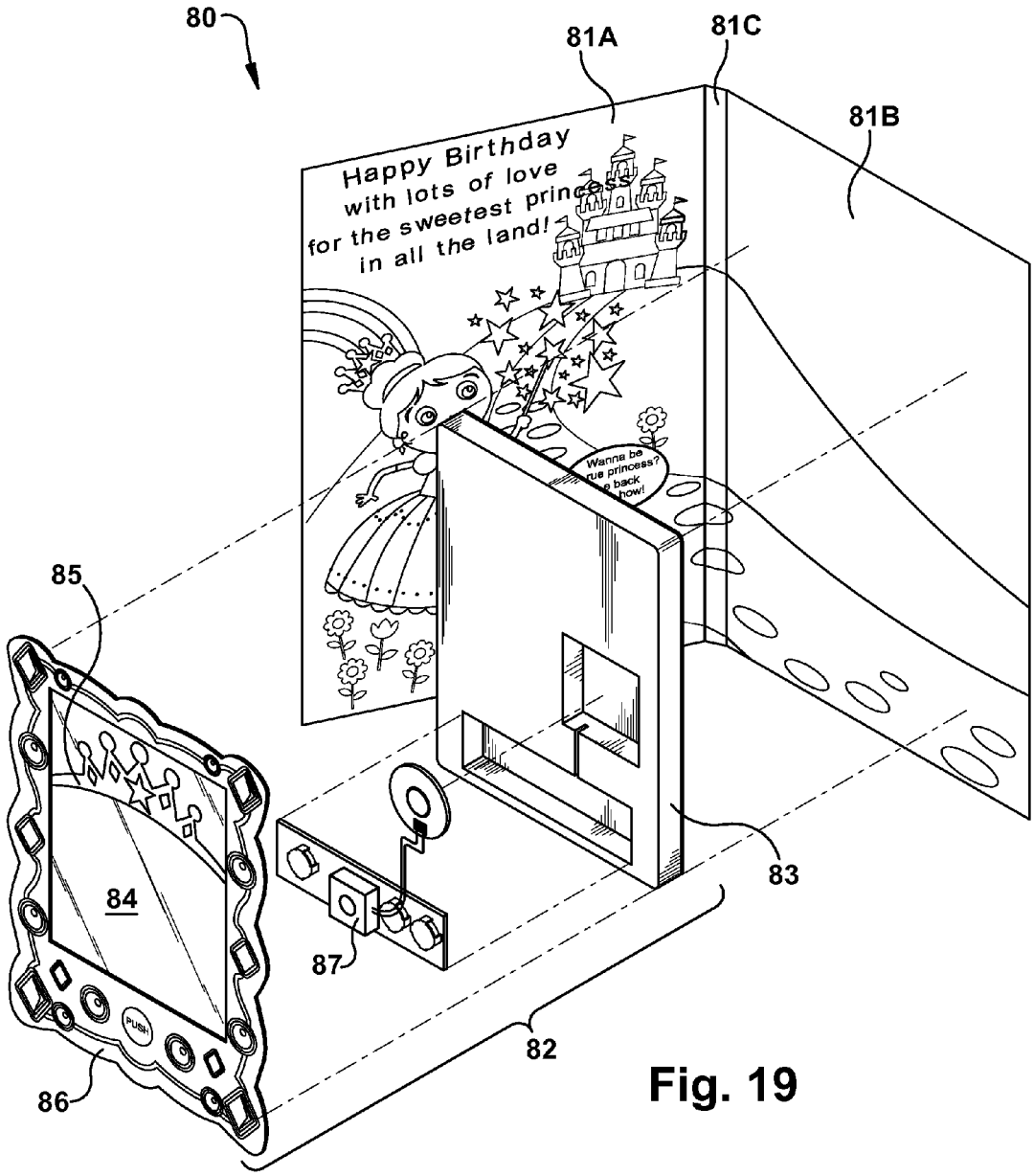
FIG. 19 is an exploded view of the three-dimensional foam greeting card of FIG. 18.

Similarly, in the embodiment shown in FIGS. 18 and 19, a traditional two panel greeting card body 81 is combined with a three-dimensional foam keepsake mirror 82. The mirrored keepsake 82 can be removed from the greeting card body 81 and used as a mirror inside of a child's school locker or displayed upon any other substantially flat planar surface. The traditional greeting card body 81 contains two main panels, a front panel 81A and a back panel 81B. The front and back panels 81A, 81B are attached via an auxiliary panel 81C which serves as a spine for the greeting card 80 to accommodate the thickness of the foam keepsake 82 which is contained inside the front and back greeting card panels 81A, 81B. The greeting card panels 81A, 81B may contain printing thereon containing text greetings, messages and various other printed artwork, photos, or other indicia. The three dimensional foam body 82, in the example shown in FIGS. 18 and 19, is formed into a substantially rectangular shape, although it can alternatively be formed into any conceivable shape. The foam body 83 contains a front surface, a back surface opposite the front surface and a perimeter surface therebetween. The back surface of the foam body is covered by a substantially planar cover material which is consistent in size and shape with the foam body 83. The back surface cover material may be made of cardboard or other material with a similar weight and rigidity so that it is able to support the weight and provide a sturdy surface for the mirrored structure 84 attached to the front surface of the foam body 83. The back surface cover material may optionally contain a display arm or easel which can be bent outward and function as a support for the three-dimensional foam mirror 82 so that it can be displayed in an upright position on a table or other flat surface, similar to a picture frame. The back surface cover material may also optionally contain a pre-cut nail holder or hanger mechanism having an opening or aperture contained thereon which can be folded outward from the back surface cover material and attached to a nail, hook or other attachment device for display on a wall or other vertical surface. A mirror 84 is attached to the front surface of the foam body 83, which is preferably consistent with the shape of the foam body 83. The size of the mirror 84 is preferably equal to or smaller than the size of the foam body 83. The mirror 84 may contain printing, a sticker, or other type of material decoration 85 thereon which makes the user look like a character, preferably a character which is printed on the greeting card. For example, as shown in FIGS. 18 and 19, the mirror 84 contains a crown 85 printed or applied to an upper portion thereof so that when a user looks into the mirror it looks like the user is wearing a crown on his/her head. A picture of a princess or queen may be printed on the greeting card body 81 to maintain the theme or general subject of the greeting card 80. Another example may have a pirate hat printed on the upper portion of the mirror 84 which makes the user look like a pirate. The mirror 84 may have a border or frame 86 attached thereto. The border or frame 86 may be a die cut shape which is made of cardboard or other substantive material. The border or frame 86 may have decorative effects printed thereon or attached thereto. The die cut frame 86 may also contain a decoratively shaped, non-linear border. The outer edges of the frame 86 may extend past the outer edges of the foam body 83. The greeting card 80 may also contain a sound module contained within the foam body 83 operative to save and replay at least one pre-recorded audio file. A switch, which in a preferred embodiment, is a push button switch 87 is also contained within the foam body 83 and is accessed through the front of the foam-backed mirror 82, preferably through the border or frame 86. The border or frame 86 may contain printing thereon indicating the general area in which the user must press in order to hear the audio playback. The audio may be spoken word, a song, a musical arrangement or any other recordable sound. The push button 87 may serve as a toggle switch so that pressing the button 87 a first time initiates playback of the audio and pressing the button 87 a second time ceases playback of the audio, and so on. The foam keepsake mirror 82 may be removably attached to an inside surface of the greeting card body 81 using adhesive or any other temporary attachment mechanism. The greeting card body 81 and foam mirror keepsake 82 may be packaged in a plastic protective sleeve to prevent damage to or detachment of the foam mirror 82. In a preferred embodiment, the greeting card body 81, foam-backed mirror 84 and audio will be coordinated to a particular theme, such as, for example, a princess theme.

Figure 11:
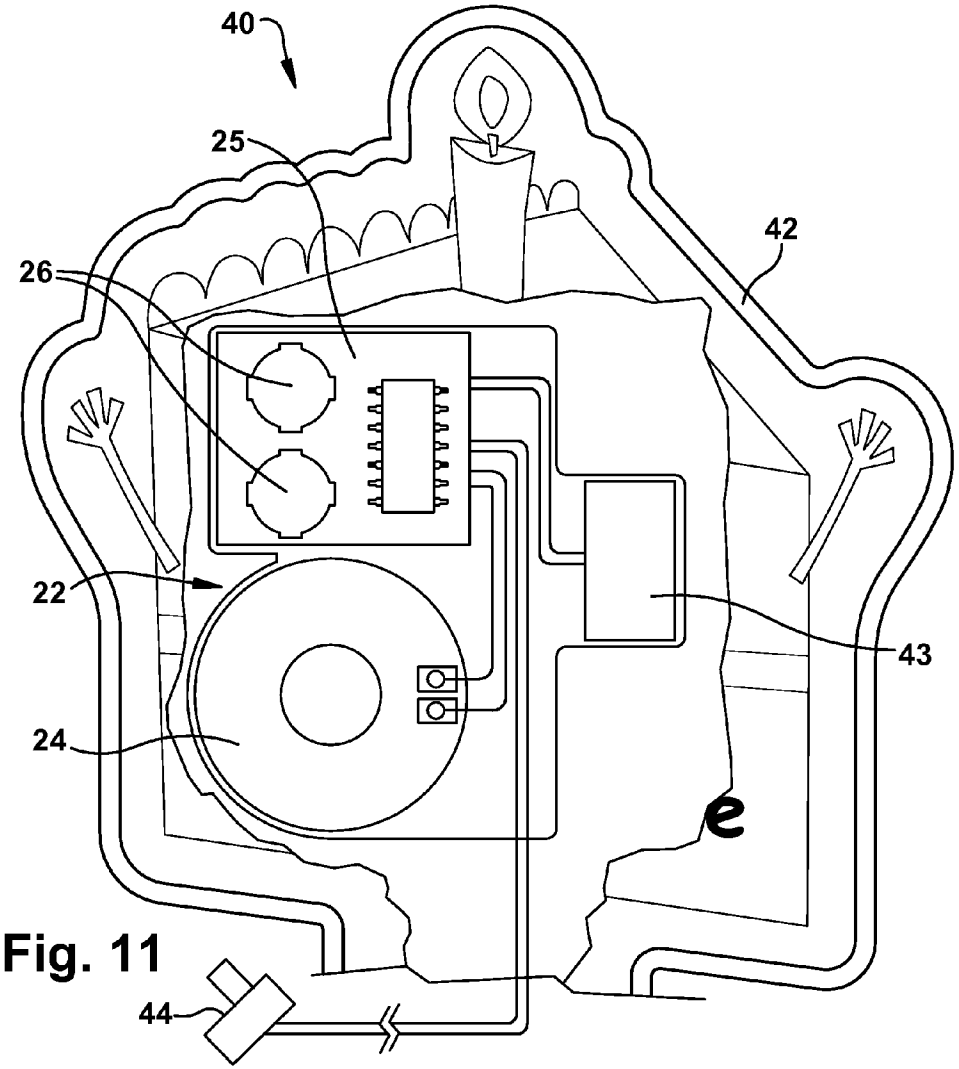
FIG. 11 is an internal view of a portion of the three-dimensional foam greeting card of FIG. 10.
Figure 10:
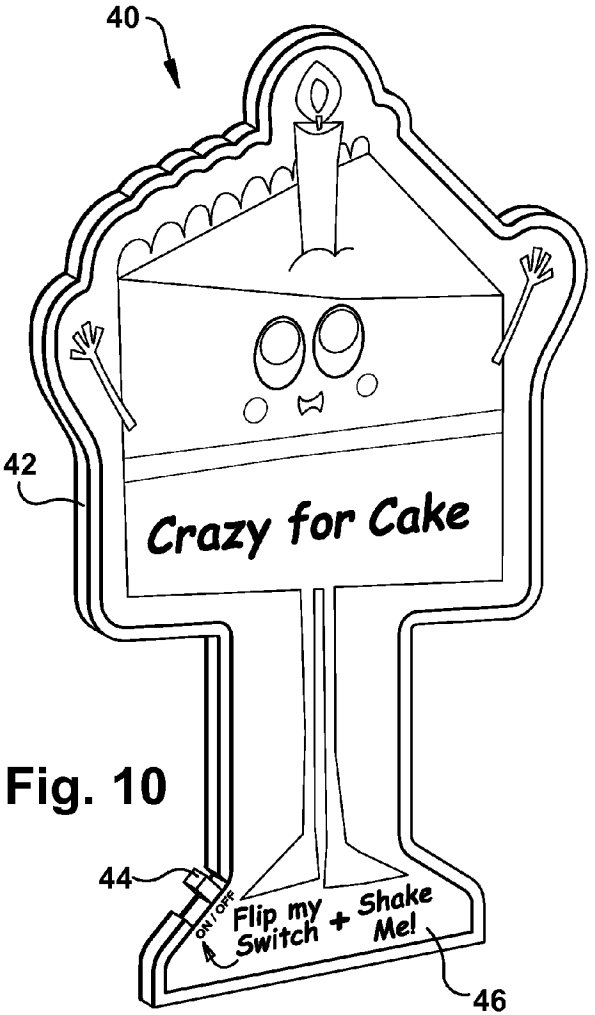
FIG. 10 is a perspective view of an alternate embodiment of the three-dimensional foam greeting card of the present invention.

The three-dimensional foam greeting cards with sound, as described above, can additionally contain a motion sensor which operates to trigger one or more pre-loaded audio files. A representative example is shown in FIGS. 10-11. In this embodiment, in additional to the sound module 22 as described above, contains a motion sensor 43 within the cavity in the foam body 42. The motion sensor 43 can be used, in one embodiment, to trigger playback of a first pre-loaded audio file. In another embodiment, a first pre-loaded audio file may be played upon activating a first switch such as a push button switch or toggling a mechanical on/off button 44, as shown in FIGS. 10-11. After the first pre-loaded audio file is played back, movement of the foam body 42 activates the motion sensor 43, which triggers a second pre-loaded audio file. For example, the greeting card 40 may contain instructions to "shake me" 46 so that when the user begins to shake the foam body 42, the motion sensor 43 triggers playback of a pre-loaded audio file.

In another embodiment, the three-dimensional foam greeting card of the present invention may contain a light module with integrated LED lights. The light module would contain A light strand may be stored within a hollowed out portion of the greeting card body between the front and back surfaces of the card. The lights may be programmed to strobe in sequence or blink randomly. Different light colorations may be used as well. Other types of lighting, such as ribbon LED lights may also be used. An electro-mechanical push-activated switch may be used to allow the user to control whether the lights are turned on or off. Also, the lights may be used in combination with pre-recorded sound or a user-recorded message. A single switch may initiate playback of a pre-recorded or user-recorded message as well as turning the lights on or the audio playback and lights may be controlled by different switches.

Figure 14:
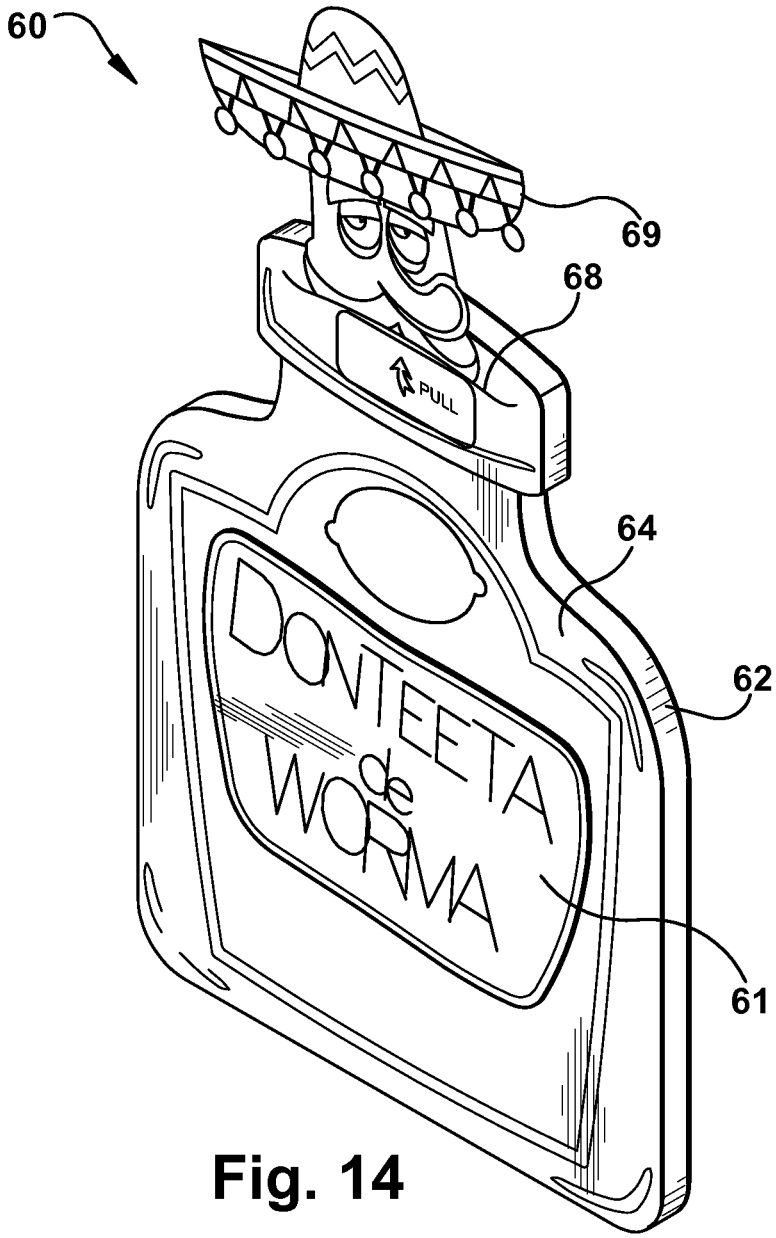
FIG. 14 is a perspective view of an alternate embodiment of the three-dimensional foam greeting card of the present invention.
Figure 15:
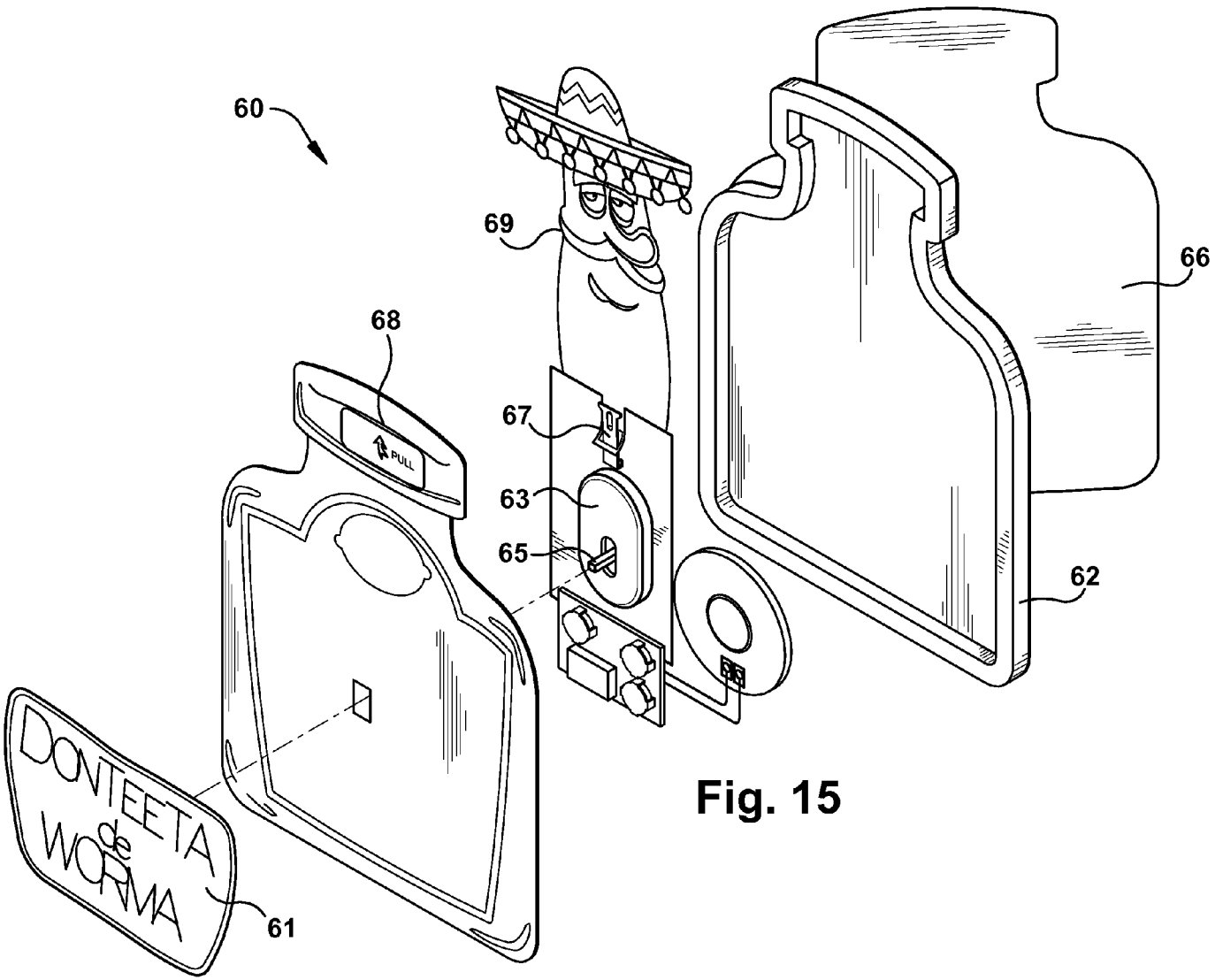
FIG. 15 is an exploded view of the three-dimensional foam greeting card of FIG. 14.

In yet another embodiment, the three-dimensional foam greeting card of the present invention may contain a motor module located in the hollowed cavity in the foam located between the front and back panels of the greeting card. The motor module causes movement of at least one mobile object associated with the greeting card. The movement may be up and down motion, side to side lateral motion, or any other reciprocating motion. The motor module may contain a rotating gear mechanism that when activated turns a circular gear which is attached at one end to the mobile object. The mobile object can be any three dimensional object which extends outward from the front surface of the greeting card body. Activation of the motor module, which can be by a push button switch, slide switch, or any other switching mechanism, causes movement of the mobile object. Other novelties may be attached to the outside surface of the foam body such as moving eyes or other decorative embellishments. An example of this embodiment is shown in FIGS. 14 and 15. A three-dimensional foam greeting card body 62, as described above with respect to the other embodiments, is formed like a bottle of tequila. It has a front cover material 64 attached to the front surface of the foam body 62 and a back cover material attached to the back surface of the foam body (also described above). The front and back cover material is shaped like the three dimensional foam body and covers the entire or a substantial portion of the front and back surfaces of the foam 62. The perimeter foam surface, which extends between the front and back surfaces, is exposed between the front and back cover materials. Alternatively, the perimeter surface may be covered by the same material as the front and back cover material or may be covered with a different type of cover material. The front or back cover material may also have a sentiment panel 66 attached thereto along a fold line, as described above. A sound module operative to store and playback at least one digital audio file is contained within the three-dimensional foam body 62. A motor module operative to effect movement of at least one movable object 61 attached to the three-dimensional foam body is also contained within the three-dimensional foam body. The sound and motor modules are concealed within the foam 62 between the front and back cover materials 64. A moveable object 61, which in the example shown in FIGS. 14 and 15, is a die cut shape, is attached directly to a motor 63 or is attached to the motor 63 via an attachment arm 65 or mechanism. However, the moveable object 61 may be a plastic object, or any other type of object which can be attached to the motor 63 having a relatively low profile and being relatively lightweight. In a preferred embodiment, the moveable object 61 is coordinated with or compliments the theme of the greeting card along with print material on the front and back cover material and also with the at least one digital audio file. The greeting card 60 also contains a switch mechanism which controls activation of the sound and motor modules. In the example shown in FIGS. 14 and 15, the switch is a contact switch which contains a contact arm 67 and an insert panel 69. The contact switch contains two contact arms 67 that when in contact with each other complete an electrical circuit. Separating the contact arms 67 breaks the circuit. When the insert panel 69 is inserted into a slot 68 in the front cover material 64 and/or the foam body 62, it gets inserted between the two arms 67 of the contact switch, thereby interrupting the circuit. Removal of the insert panel 69 from the slot 68 removes the barrier between the two contact arms 67 such that they are again in direct contact with each other thereby completing the circuit and initiating playback of at least one audio file contained on a memory device of the sound module. Re-inserting of the insert panel 69 into the slot 68 and between the two arms 67 of the contact switch deactivates the audio playback. The arms of the contact switch 67 may be of any length, however, a longer length is preferred over a shorter length, to ensure proper placement of the insert panel 69 between the two arms 67 of the switch as it is inserted into the slot 68 in the front cover material 64. The insert panel 69, in the example shown is a die cut shape, which compliments or is coordinated with the theme of the greeting card. In the example shown, the foam body 62 and front and back cover material 64 are shaped and decorated like a tequila bottle, the pre-recorded audio is a song "Tequila" and the insert panel 69 is a worm. The insert panel 69 when it is in a first position, between the arms of the contact switch 67, an upper portion of the insert panel 69 is located outside the slot 68 and the foam body 62, as shown in FIG. 14. The visible portion of the insert panel 69 is at least enough to accommodate a user gripping the insert panel 69 between a thumb and forefinger and pulling up to remove the insert panel 69 from between the arms 67 of the contact switch. When the insert panel 69 is in this second position, wherein it is substantially removed from the slot 68, it is no longer a barrier between the two arms 67 of the contact switch, thereby initiating playback of the at least one audio file. The insert panel 69 may be completely removable from the slot 68 and the foam body 62 or it may only be partially removable so as to not separate the insert panel 69 from the foam greeting card body 62. The slot 69 in the front cover material 64 is slightly larger than the width of the insert panel 69 for easy insert and removal of the insert panel 69 from the slot 69. An upper portion of the insert panel 69 may have a width which is larger than the slot 69 in the front cover 68 to prevent the insert panel 69 from becoming completely contained within the slot 68 and foam body 62. The length of the insert panel 69 may also be varied (longer than the distance between the contact switch and the slot 68) to prevent this as well.

Figure 13:
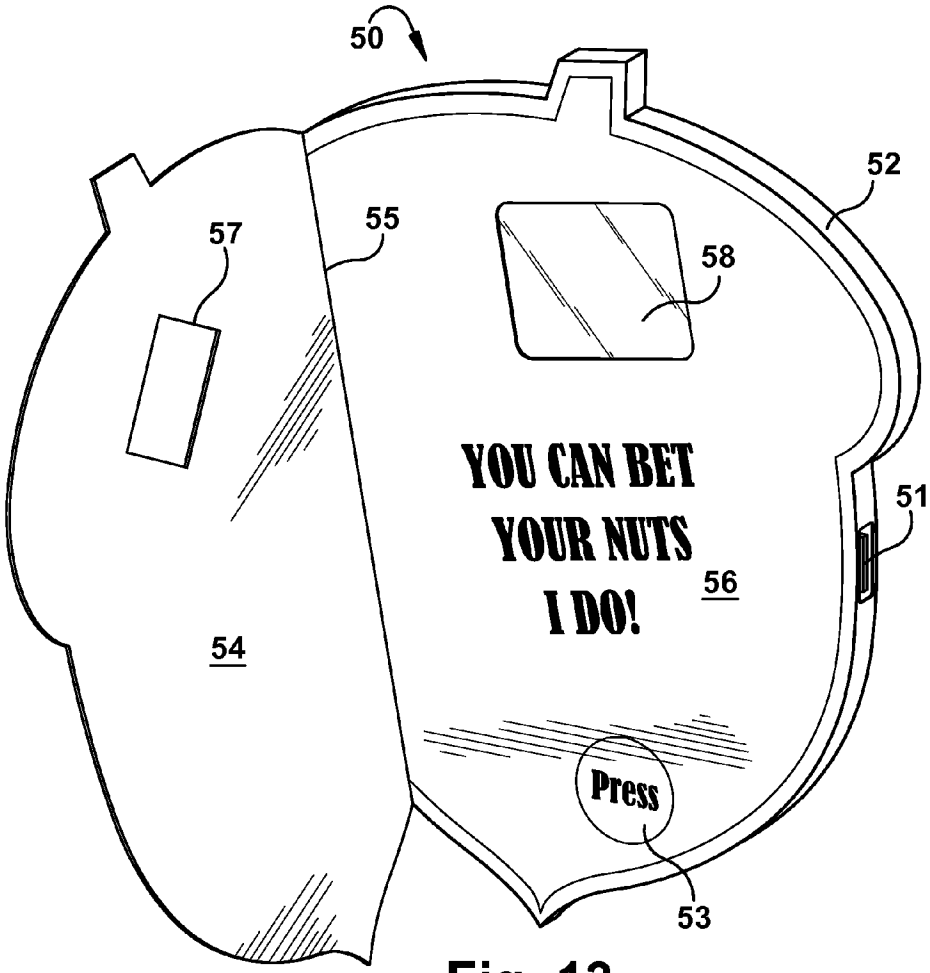
FIG. 13 is a perspective inside view of the three-dimensional foam greeting card of FIG. 12 in an open position.
Figure 12:
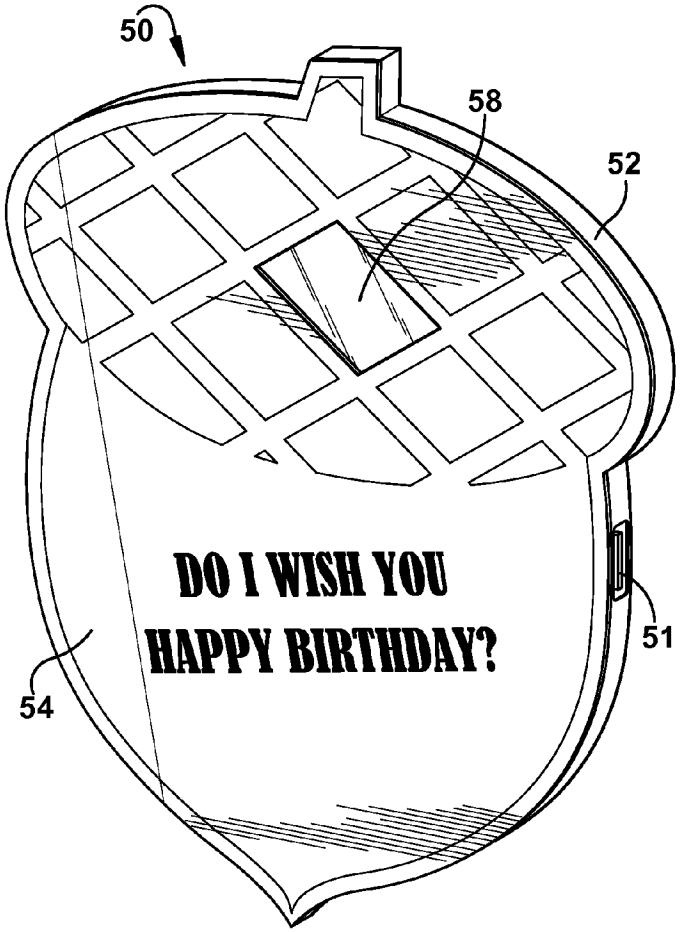
FIG. 12 is a perspective view of an alternate embodiment of the three-dimensional foam greeting card of the present invention in a closed position.

In still another embodiment, the three-dimensional foam greeting card of the present invention may be operative to play pre-loaded video and/or audio recordings. In this embodiment, a representative example of which is shown in FIGS. 12 and 13, a multimedia player device is contained within the hollowed cavity in the foam body 52 located between the front and back panels of the greeting card 50. The multimedia player device may be capable of displaying pre-loaded images or video and emitting sound. Components of such multimedia player device may include, but are not limited to, a flat panel display screen 58, such as an LCD screen, a power source which preferably consists of one or more disposable batteries, an audio speaker, integrated circuit, a circuit board with microprocessor, a data storage device and related circuitry. The device may contain at least one pre-recorded slideshow with accompanying pre-recorded digital audio files. A representative device may store up to approximately 20 pre-loaded photos or images and between approximately 26 seconds to 2.26 minutes of audio or greater, depending on the amount of digital storage provided. The device, when powered by four disposable lithium batteries, is capable of playing the pre-loaded audio/visual content approximately 300 times. Representative width and/or height dimensions of a display screen 58 are between approximately 1.5 and 2.4 inches. The screen 58 may be visible through an opening in the planar sheet material located on the front surface 56 of the foam body 52. The foam greeting card body 52 may additionally contain a sentiment panel 54, as described above, which is attached along a fold line 55 to the planar sheet material attached to the front surface 56 of the foam body 52. The sentiment panel 54 would serve as the front cover of the greeting card 50 and in a closed position, lay atop the sheet material attached to the front surface 56 of the foam body 52. The sentiment panel 54 may also contain an opening thereon 57, consistent with the opening for the display screen 58 contained on the planar sheet material located on the front surface 56 of the foam body 52, through which the display screen 58, contained within the foam body 52, is visible. The multimedia display device may be activated by a push button switch 53 located on the front or back surface of the foam body 52. The greeting card 50 may contain the words "play" printed above the push button switch 53 which indicates where the multimedia player device is activated. Alternatively, the greeting card 50 may contain a slide switch which is used in combination with a sentiment panel 57, as described above. The slide switch may be located across a fold line 55 between the sentiment panel 54 and the foam greeting card body 52, such that when the greeting card 50 is opened or the sentiment panel 54 is folded away from the greeting card body 52, the slide switch works to activate the multimedia player. The greeting card 50 may additionally contain a mechanical on/off switch or button which controls whether or not the multimedia player device may be activated. The on/off switch may be located along the side perimeter of the foam body 52 between the planar sheet material located on the front and back surfaces of the foam body or it may be located on the front or back surface of the greeting card body.

A further embodiment of the three dimensional foam greeting card with multimedia player device, as described directly above, may contain audio recording capabilities which would provide a user with the ability to record a personalized message to be played before, during or after the pre-recorded slideshow is displayed on the display screen. Additional components such as a sound and recording module, as described above with reference to a previous embodiment, would accompany the multimedia player device within the cavity located within the foam body between the front and back panels of the greeting card. The multimedia player device may contain one or more pre-recorded audio files that may be played before during or after the personalized user recorded message.

Further still, the three dimensional foam greeting card with multimedia player device may additionally include a USB port 51, SD slot or any other appropriate external memory input source so that a user may upload digital video, digital photos and/or digital audio files to be presented on activation of the multimedia device. The multimedia device may be capable of playing several file formats including, but not limited to, flash, html, html5, mp3, mp4, .mov, .rp4, /wma, etc. The multimedia player device may also contain one or more pre-loaded digital video, photo and/or audio files which may be played in combination with the user uploaded digital video, photo and/or audio. The video, slideshow and/or audio may be triggered by any of the switch mechanisms described herein and playback may further be controlled by a mechanical on/off switch. The switch mechanisms may be located on the front or back of the greeting card or along the side perimeter of the foam structure.

Figure 17:
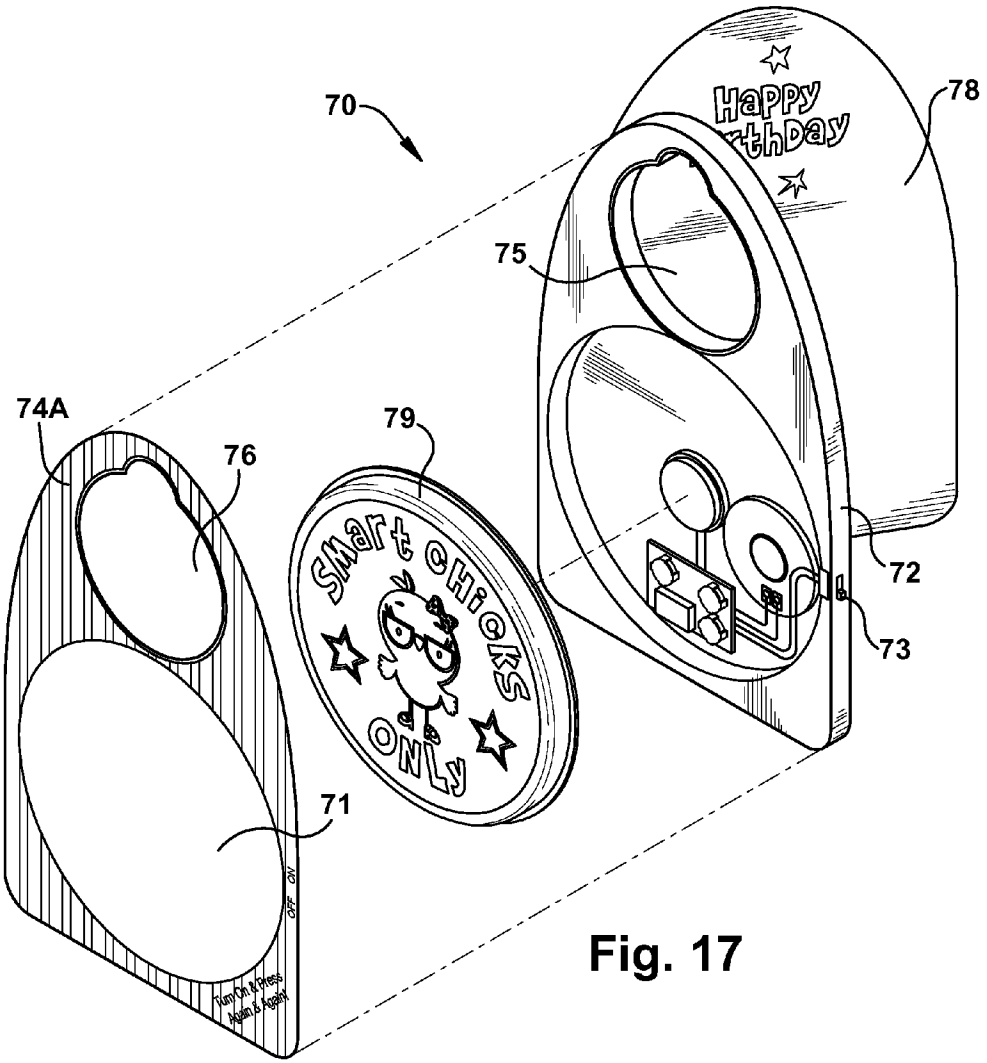
FIG. 17 is an exploded view of the three-dimensional foam greeting card of FIG. 16.
Figure 16:
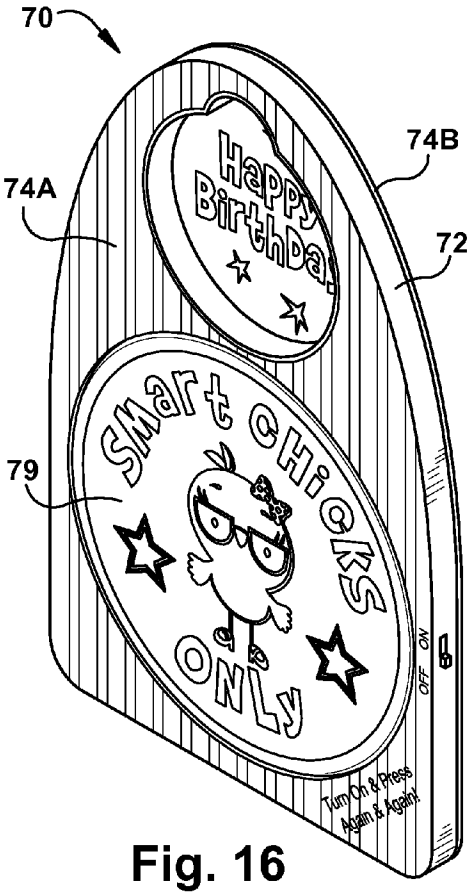
FIG. 16 is a perspective view of an alternate embodiment of the three-dimensional foam greeting card of the present invention.

In another embodiment of the present invention, a three dimensional foam greeting card takes the form of a talking door hanger 70. As shown in FIGS. 16 and 17, the greeting card/door hanger 70 contains a three-dimensional foam body 72, which as described above with respect to the other embodiments contains a front surface, a back surface opposite the front surface, and a perimeter surface extending therebetween. A front cover material 74A is attached to the front surface and a back cover material 74B is attached to the back surface. The perimeter surface is exposed between the front and back cover materials 74, although in other embodiments it may be covered as well. The foam body 72 and front and back cover materials 74 may be shaped into any form and in the present embodiment, is shaped like a traditional door hanger or sign having an elongate shape with an opening thereon 76 through which a door knob or door handle can be inserted for display outside of a door. As described above the front or back cover material 74 may contain a sentiment panel 78 attached thereto along a fold line. The sentiment panel 78, in combination with the front or back cover material 74, operates as a traditional two panel greeting card which is attached to the foam door hanger 70. A larger circular push button 79 extends outward from an opening 71 in the foam body 72 and front surface material 74A. A sound module operative to store and playback at least one digital audio file is contained within the foam body 72 between the front and back cover material 74. The push button 79 is a switch which controls activation of the sound module. The push button 79, in a preferred embodiment is plastic, but it can be made of any other material. The front surface of the push button 79 may contain printing thereon. The greeting card/door hanger 70 may also contain an on/off switch 73 which is contained within the foam body 72 and accessed through a perimeter of the foam body 72. The on/off switch 73 must be moved to the "on" position before the push button 79 will activate playback of the audio file. This prevents accidental pressing of the push button 79 causing playback of the audio while the greeting card/door hanger 70 is in an envelope or before presentation to the greeting card recipient. The at least one audio file may contain a spoken greeting, a song, a musical arrangement or any other recordable sound. The sentiment panel 78, when attached to the back cover material 74B may contain a perforated circle in the exact size and shape of the opening 71 in the foam body 72 and front cover material 74A for insertion of a door knob or handle. Prior to using the greeting card 70 as a door handle, the perforated portion is attached to the sentiment panel 78 and may contain a greeting or message such as "Happy Birthday", which can be seen through the opening 75, 76 in the foam body 72 and front cover material 74A from the front of the greeting card/door hanger 70. Once the recipient has received and read the greeting card, he/she can remove the circular perforated portion so that the door hanger/sign 70 can be inserted onto a door knob or handle.

The three-dimensional foam greeting cards of the present invention may also contain a battery-saving device which includes a small substantially rectangular plastic insert which is inserted into a small slot in the foam body. The slot is located directly outside the location of a battery circuit switch which is contained on the circuit board inside the foam body. When the device is inserted into the slot the circuit is opened, preventing batteries from draining while the product is not in use. When the device is removed, the circuit closes, and the batteries are activated, allowing the user to record a message, play an audio clip, light up the greeting card or cause components of the greeting card to be put in motion.

It should be noted that the three-dimensional foam greeting card described herein may contain one or a combination of two or more functions, as described, such as sound, light, audio, recording, motion, or multimedia functions. Additionally, a variety of switches are mentioned herein and can be used alone or in combination and may be located in a variety of locations on the three-dimensional foam greeting card.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card comprising:
a foam body;
a moveable object;
a sound module located within the foam body, the sound module operative to store and playback at least one audio file;
a motor module located within the foam body, the motor module operative to effect movement of the moveable object; and
a removable panel which is operative to move between a first position wherein the removable panel is substantially contained within the foam body and between two arms of a contact switch and a second position wherein the removable panel is substantially outside of the foam body and removed from between the two arms of the contact switch.

2. The greeting card of claim 1, wherein the removable panel controls activation of the motor module.

3. The greeting card of claim 1 further comprising a greeting card attached to the back surface of the foam body.

* * * * *